US008955490B2

(12) United States Patent
Sahashi

(10) Patent No.: US 8,955,490 B2
(45) Date of Patent: Feb. 17, 2015

(54) FUEL-PRESSURE-SENSOR DIAGNOSIS DEVICE

(71) Applicant: Denso Corportion, Kariya, Aichi-pref. (JP)

(72) Inventor: Toshiyasu Sahashi, Kariya (JP)

(73) Assignee: Denso Corporation, Kariya (JP)

( * ) Notice: Subject to any disclaimer, the term of this patent is extended or adjusted under 35 U.S.C. 154(b) by 169 days.

(21) Appl. No.: 13/684,371

(22) Filed: Nov. 23, 2012

(65) Prior Publication Data

US 2013/0125862 A1 May 23, 2013

(30) Foreign Application Priority Data

Nov. 23, 2011 (JP) ..... 2011-255612

(51) Int. Cl.

| | |
|---|---|
| ***F02D 1/00*** | (2006.01) |
| ***F02M 69/54*** | (2006.01) |
| ***F02M 57/00*** | (2006.01) |
| ***F02D 41/22*** | (2006.01) |
| *F02D 1/02* | (2006.01) |

(52) U.S. Cl.

CPC ..... *F02M 69/54* (2013.01); *F02M 57/005* (2013.01); *F02D 41/222* (2013.01); *F02D 2041/223* (2013.01); *F02M 2200/247* (2013.01); *F02D 2200/0602* (2013.01); *F02D 2250/04* (2013.01)

USPC ..... 123/198 D; 123/387

(58) Field of Classification Search

USPC ..... 123/198 D, 456, 447, 382, 387; 73/114.43; 701/114

See application file for complete search history.

(56) References Cited

U.S. PATENT DOCUMENTS

| | | | | |
|---|---|---|---|---|
| 2006/0054149 | A1 | 3/2006 | Uchiyama | |
| 2006/0137436 | A1 | 6/2006 | Buck et al. | |
| 2006/0287806 | A1 * | 12/2006 | Hori | 701/114 |
| 2009/0056677 | A1 | 3/2009 | Nakata et al. | |
| 2009/0082941 | A1 | 3/2009 | Nakata et al. | |
| 2009/0118981 | A1 * | 5/2009 | Kondo et al. | 701/104 |

FOREIGN PATENT DOCUMENTS

| | | |
|---|---|---|
| JP | 63-153422 | 6/1988 |
| JP | 10-115534 | 5/1998 |
| JP | 2003-286888 | 10/2003 |
| JP | 2006-504113 | 2/2006 |
| JP | 2010-138915 | 6/2010 |

OTHER PUBLICATIONS

Office Action (2 pages) dated Sep. 24, 2013, issued in corresponding Japanese Application No. 2011-255612 and English translation (2 pages).

* cited by examiner

*Primary Examiner* — Mahmoud Gimie
(74) *Attorney, Agent, or Firm* — Nixon & Vanderhye P.C.

(57) ABSTRACT

A fuel-pressure-sensor diagnosis device is applied to a fuel injection system having a plurality of fuel pressure sensors detecting a fuel pressure which is provided to a fuel injector of each cylinder, and a control portion controlling the fuel injectors by using a computed result which is computed based on a variation in the fuel pressure detected by the fuel pressure sensor due to a fuel injection. Two pressure sensors of which pulsation values of the detected fuel pressure are in a specified range are selected among the multiple fuel pressure sensors. For example, a pair "A" refers to the sensors #1 and #3, a pair "B" refers to the sensors #3 and #4, a pair "C" refers to the sensors #4 and #2, and a pair "D" refers to the sensors #2 and #1. An ECU diagnoses whether the selected sensors are faulty by comparing the detected values.

6 Claims, 6 Drawing Sheets

FIG. 2A
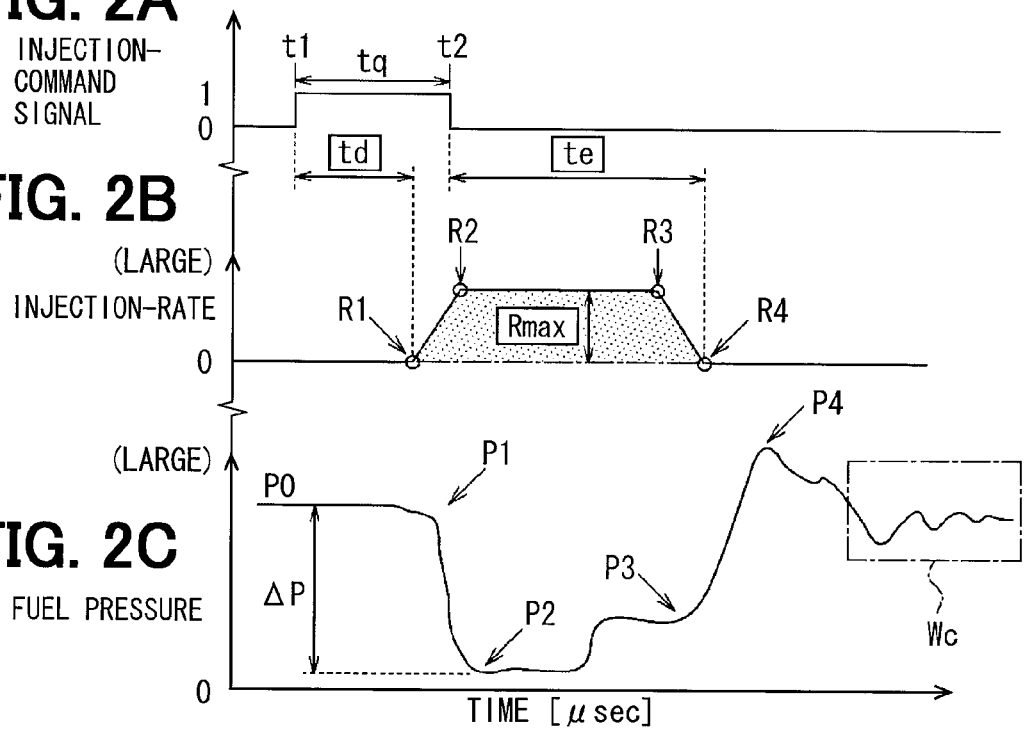
FIG. 2B
FIG. 2C
FIG. 3A
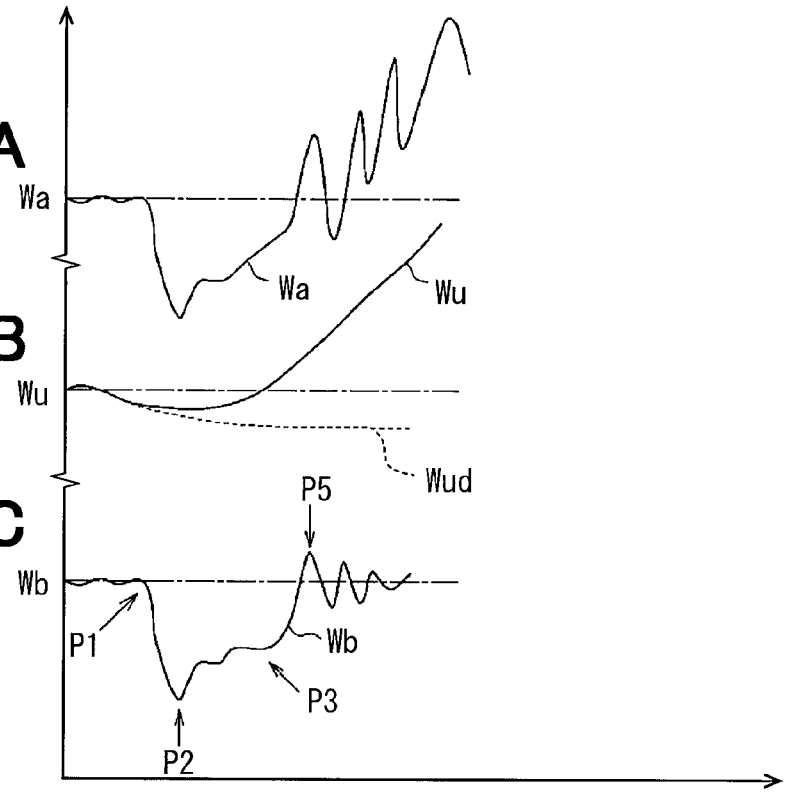
FIG. 3B
FIG. 3C

FUEL PRESSURE (MPa)
A
B
C
D
Pth
P#1
P#2
P#3
P#4

FIG. 8A

| | A<br>P#1-P#3 | B<br>P#3-P#4 | C<br>P#4-P#2 | D<br>P#2-P#1 | NUMBER |
|---|---|---|---|---|---|
| SENSOR #1 | × | | | × | 2 |
| SENSOR #2 | | | × | × | 2 |
| SENSOR #3 | × | × | | | 2 |
| SENSOR #4 | | × | × | | 2 |

FIG. 8B

| | | A<br>P#1-P#3 | B<br>P#3-P#4 | C<br>P#4-P#2 | D<br>P#2-P#1 | NUMBER |
|---|---|---|---|---|---|---|
| SENSOR #1 | Hi | × | | | × | 2 |
| | Lo | | | | | 0 |
| SENSOR #2 | Hi | | | × | | 1 |
| | Lo | | | | × | 1 |
| SENSOR #3 | Hi | | × | | | 1 |
| | Lo | × | | | | 1 |
| SENSOR #4 | Hi | | | | | 0 |
| | Lo | | × | × | | 2 |

FUEL-PRESSURE-SENSOR DIAGNOSIS DEVICE

CROSS-REFERENCE TO RELATED APPLICATION

This application is based on Japanese Patent Application No. 2011-255612 filed on Nov. 23, 2011, the disclosure of which is incorporated herein by reference.

TECHNICAL FIELD

The present disclosure relates to a fuel-pressure-sensor diagnosis device, which diagnoses whether a fuel pressure sensor detecting a fuel pressure is faulty.

BACKGROUND

According to JP-2006-77709A (US-2006-0054149A1), a fuel pressure sensor detecting a pressure of a fuel supplied to a fuel injector is used for a fuel injection system which distributes the high-pressed fuel from a common rail (accumulator container) to the fuel injector provided in each cylinder of an internal combustion engine. Besides, the fuel pressure sensor is mounted to the common rail for controlling a pressure in the common rail (rail pressure) so that a detection value of the fuel pressure sensor is equal to a target value. It is diagnosed by the following method whether an abnormality (malfunction) occurs in the fuel pressure sensor.

When the fuel is injected from the fuel injector, the rail pressure descends. Therefore, it is diagnosed that the abnormality (malfunction) occurs in the fuel pressure sensor when a decreasing amount of the detection value of the fuel pressure sensor due to a fuel injection significantly deviates from a specified decreasing amount (standard decreasing amount).

A fuel pressure sensor outputs an output level signal, which is represented by a solid line L1 in FIG. 4, corresponding to a fuel pressure as a detected value. It is likely that the output signal may deviate from the solid line L1 when the fuel pressure sensor deteriorates with age, as shown by solid lines L3 in FIG. 4. In this case which is referred to as an offset abnormality, since a slope of the output signal (solid lines L3) is normal, a decreasing amount of the detected value is not shifted too much with respect to a standard decreasing amount (solid line L1). Thus, even when the above offset abnormality occurs, it is erroneously diagnosed that the output signal is normal, and the above offset abnormality of the fuel pressure sensor cannot be detected.

SUMMARY

The present disclosure is made in view of the above matter, and it is an object of the present disclosure to provide a fuel-pressure-sensor diagnosis device which can diagnose whether an offset abnormality of a fuel pressure sensor occurs.

The present disclosure is applied to a fuel injection system having a plurality of fuel injectors provided to each cylinder of an internal combustion engine, an accumulator accumulating a high-pressure fuel and distributing the fuel to the fuel injectors, a fuel pressure sensor detecting a fuel pressure in a fuel supply passage from the accumulator to an injection port of the fuel injector, and a control portion controlling the fuel injectors by using a computed result which is computed based on a detected value change of the fuel pressure sensor in a fuel injection from a injection port.

The fuel pressure sensor abnormality diagnosis device includes an abnormality-diagnosis portion diagnosing whether there are abnormal in two fuel pressure sensors which are selected from the plurality of fuel pressure sensors in a manner that pulsation values of detected values of the selected sensors are in a specified range by comparing the detected values.

In the fuel injection system in which a fuel injection state is computed based on a detected value change of the fuel pressure sensor, it is preferable that one fuel pressure sensor is provided to each cylinder so that the fuel injection state of each cylinder is computed based on the detected value of the fuel pressure sensor. When the offset abnormality happens in one of the sensors, the detected values are greatly apart from each other. Thus, the offset abnormality can be detected by comparing the detected value of the fuel pressure sensor from each other. In addition, when the detected values change due to a fuel injection, the offset abnormality cannot be detected.

According to the present disclosure, two fuel pressure sensors are selected from the plurality of the fuel pressure sensors so that pulsation values of the detected values are in a specified range. The diagnosis whether there is an offset abnormality can be made by comparing the detected values of the selected fuel pressure sensors.

BRIEF DESCRIPTION OF THE DRAWINGS

The above and other objects, features and advantages of the present disclosure will become more apparent from the following detailed description made with reference to the accompanying drawings. In the drawings:

FIGS. 2A, 2B, and 2C are graphs showing variations in a fuel injection-rate and a fuel pressure relative to a fuel injection command signal;

FIGS. 3A, 3B and 3C are charts which respectively show an injection-cylinder pressure waveform Wa, a non-injection-cylinder pressure waveform Wu, and an injection pressure waveform Wb;

FIG. 8A is a chart showing a diagnosis result according to the first embodiment in a case where two sensors #1 and #4 are abnormal, and FIG. 8B is a chart showing a diagnosis result according to a second embodiment in a case where two sensors #1 and #4 are abnormal.

DETAILED DESCRIPTION

Hereafter, embodiments of the present disclosure will be described according to the drawings. The following embodiments are specific examples, and the present disclosure is not limited to these embodiments.

Hereinafter, embodiments of the present invention will be described. A diagnostic apparatus for a fuel injector is applied to an internal combustion engine (diesel engine) having four cylinders #1-#4.

First Embodiment

Figure 1:
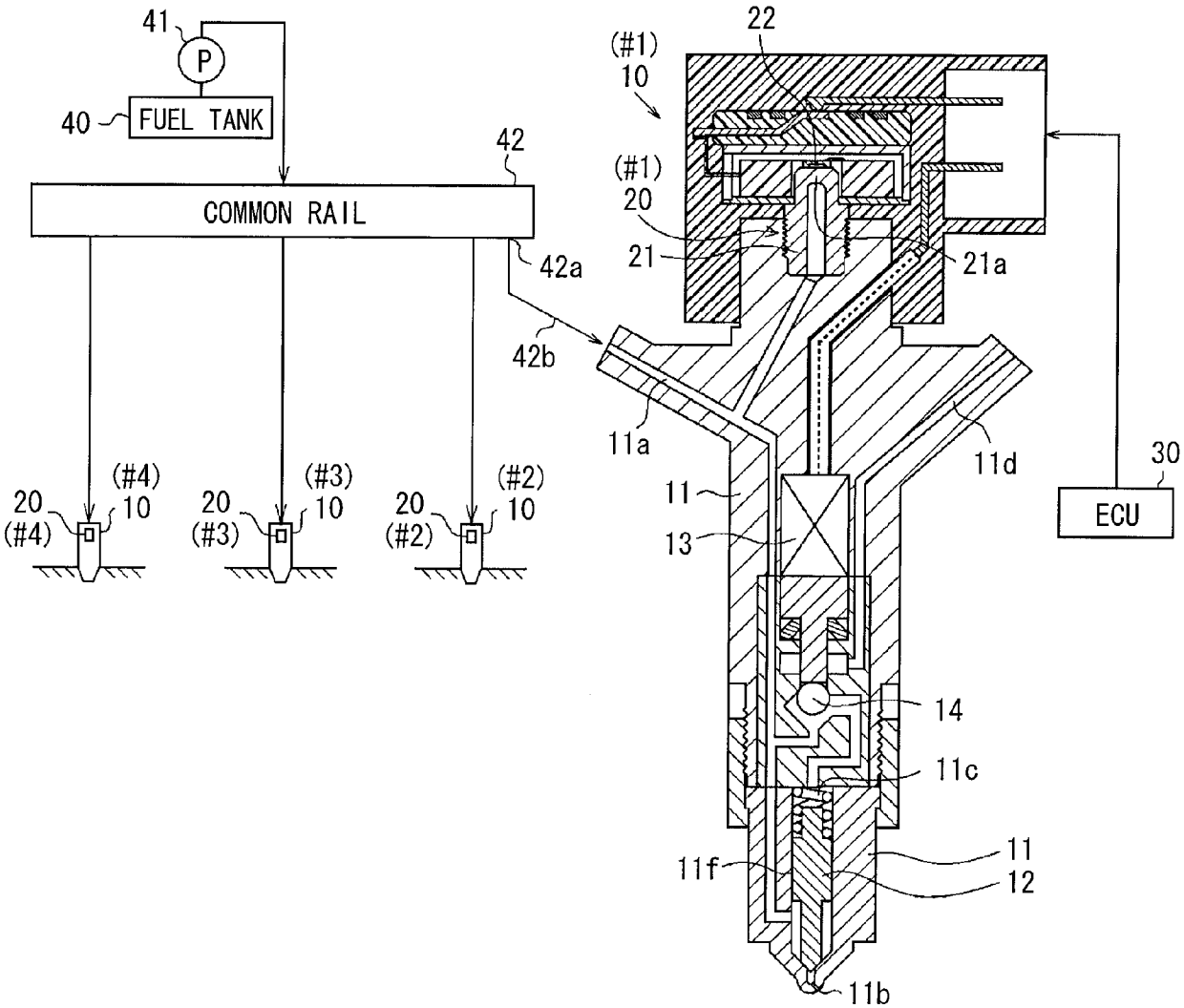
FIG. 1 is a construction diagram showing an outline of a fuel injection system to which a fuel-pressure-sensor diagnosis device is applied, according to a first embodiment.

FIG. 1 is a schematic view showing fuel injectors 10 provided to each cylinder, a fuel pressure sensor 20 provided to each fuel injector 10, an electronic control unit (ECU) 30 and the like.

First, a fuel injection system of the engine including the fuel injector 10 will be explained. A fuel in a fuel tank 40 is pumped up by a high-pressure pump 41 and is accumulated in a common-rail (accumulator) 42 to be supplied to each fuel injector 10 (#1-#4). Each fuel injector 10 (#1-#4) performs a fuel injection sequentially in a predetermined order. In the present embodiment, the fuel injector #1, the fuel injector #3, the fuel injector #4, and the fuel injector #2 perform fuel injections in this order.

The high-pressure fuel pump 41 is a plunger pump which intermittently discharges high-pressure fuel. Since the fuel pump 41 is driven by the engine through the crankshaft, the fuel pump 41 discharges the fuel predetermined times while the fuel injectors 10 inject the fuel in the above order.

The fuel injector 10 is comprised of a body 11, a needle valve body 12, an electronical actuator 13 and the like. The body 11 defines a high-pressure passage 11*a* and an injection port 11*b*. The needle valve body 12 is accommodated in the body 11 to open/close the injection port 11*b*.

The body 11 defines a backpressure chamber 11*c* with which the high-pressure passage 11*a* and a low-pressure passage 11*d* communicate. The electronical actuator 13 controlled by the ECU 30 activating a control valve 14 so as to switch a communicating state between the high-pressure passage 11*a*, the low-pressure passage 11*d* and the backpressure chamber 11*c*.

When the control valve 14 is activated so that the backpressure chamber 11*c* is communicated with the low-pressure passage 11*d*, a fuel pressure in the backpressure chamber 11*c* descends. Then, the valve body 12 is lift-up (opening valve operation), thereby the injection port 11*b* is opened. Therefore, the high-pressed fuel supplied from a common rail 42 to the high-pressure passage 11*a* is injected toward a combustion chamber through the injection port 11*b*. When the control valve 14 is activated so that the backpressure chamber 11*c* is communicated with the high-pressure passage 11*a*, the fuel pressure in the backpressure chamber 11*c* ascends. Then, the valve body 12 is lift-down (closing valve operation), thereby the injection port 11*b* is closed. Thus, the fuel injection is stopped.

The fuel pressure sensor 20 includes a stem 21 (load cell) and a pressure sensor element 22. The stem 21 is provided to the body 11. The stem 21 has a diaphragm 21*a* which elastically deforms in response to high fuel pressure in the high-pressure passage 11*a*. The pressure sensor element 22 is disposed on the diaphragm 21*a* to transmit a pressure detection signal depending on an elastic deformation of the diaphragm 21*a* toward the ECU 30.

The fuel pressure sensor 20 is mounted to each fuel injector 10. Hereinafter, the fuel injector 10 mounted to the cylinder #1 is referred to as the fuel injector #1, and the fuel pressure sensor 20 mounted to the fuel injector #1 is referred to as a sensor #1. As the same, the fuel injectors (#2-#4) and the fuel pressure sensors (#2-#4) are respectively referred to as fuel injectors (#2-#4) and sensors (#2-#4).

The ECU 30 has a microcomputer which computes a target fuel injection condition, such as the number of fuel injections, a fuel-injection-start time, a fuel-injection-end time, and a fuel injection quantity. For example, the microcomputer stores an optimum fuel-injection condition with respect to the engine load and the engine speed in a fuel-injection condition map. Then, based on the current engine load and the engine speed, the target fuel-injection condition is computed in view of the fuel-injection condition map.

The fuel-injection-command signals t1, t2, tq (refer to FIG. 2A) corresponding to the computed target injection condition are established based on the injection-rate parameters "td", "te", Rmax, which will be described later in detail. Learning values of the injection rate parameters are computed based on a variation in a detected value of the fuel pressure sensor 20 (fuel pressure waveform).

Referring to FIGS. 2A to 3, a learning method for computing the injection-rate parameters will be described hereinafter. In the following description, the injection-rate parameters are computed based on a detected value of the sensor #1 when the fuel is injected by the fuel injector #1. Moreover, the other injection-rate parameters are computed based on detected values of sensors #2-#4 when the fuel is injected by the fuel injectors #2-#4.

For example, in a case that the fuel injector #1 mounted to the cylinder #1 injects the fuel, a variation in fuel pressure due to a fuel injection is detected as a fuel pressure waveform (refer to FIG. 2C) based on the detected value of the sensor #1. Based on the detected fuel pressure waveform, an injection-rate waveform (refer to FIG. 2B) representing a variation in a fuel injection quantity per unit time is computed. Then, the injection-rate parameters "td", "te" and Rmax identifying the injection-rate waveform (injection state) are learned and used in an injection control of the fuel injector #1.

The detected value of the sensor #1 shown by the fuel pressure waveform in FIG. 2C decreases from an inflection point P1 at which the fuel injection is started to an inflection point P2 at which a maximum injection-rate is achieved. Then, the detected value of the sensor #1 increases from an inflection point P3 at which the valve body 12 is lifted up to start the fuel injection to an inflection point P4 at which the valve body 12 is lifted down to stop the fuel injection. The detected value pulsates repeatedly in the increasing and the decreasing direction, and the amplitude attenuates (refer to a line We surrounded by a dashed-dotted line in FIG. 2C).

The fuel pressure waveform correlates with the injection-rate waveform shown in FIG. 2B. Specifically, a time point that the inflection point P1 occurs has a correlation with an injection starting point R1. Further, a time point that the inflection point P3 occurs has a correlation with an injection complete point R4. Moreover, a pressure decreasing amount □P from the inflection point P1 to the inflection point P2 has a correlation with the maximum injection-rate (injection-rate parameter Rmax).

FIG. 2A is a graph showing the fuel-injection-command signals outputted by the fuel injector #1. The injection-rate parameter "td" (injection start time delay "td") is a time delay of the injection starting point R1 relative to an injection-start-command point t1. The injection-rate parameter "te" (injection complete time delay "te") is a time delay of the injection complete point R4 relative to an injection-complete-command point t2.

Therefore, correlation coefficients indicating the above correlations are previously obtained by a pre-test. By using the correlation coefficients, the injection-rate parameters "td", "te", Rmax are computed based on the inflection points P1, P3 and the pressure decreasing amount □P. Moreover, the injection-rate waveform can be measured based on the injection-rate parameter "td", "te", Rmax. An injection amount can be computed based on an area of the measured injection-rate waveform (refer to a dotted area of FIG. 2B).

Thus, by using the detected value of the fuel pressure sensor 20, an actual injection state (injection-rate parameters "ta", "te", Rmax and injection amount) relative to the fuel-injection-command signals can be computed and learned. Based on the learning value, the fuel-injection-command signals corresponding to a target injection state are established. The ECU 30 (control portion) feedback controls the fuel-injection-command signals based on the actual injection state. The actual injection state can be accurately controlled in such a manner as to agree with the target injection state, even if an aged deterioration is advanced such as clog or wear in the injection port 11*b*. Especially, the fuel-injection-command period tq is feedback controlled based on the injection-rate parameters so that the actual injection amount agrees with the target injection amount.

In the following description, a cylinder in which a fuel injection is currently performed is referred to as an injection cylinder and a cylinder in which no fuel injection is currently performed is referred to as a non-injection cylinder. Further, the fuel pressure sensor 20 provided in the injection cylinder is referred to as an injection sensor and the fuel pressure sensor 20 provided in the non-injection cylinder is referred to as a non-injection sensor.

The fuel pressure waveform Wa (refer to FIG. 3A) detected by the injection-cylinder sensor includes not only the waveform due to a fuel injection but also the waveform due to other matters described below. In a case that the fuel pump 41 intermittently supplies the fuel just like a plunger pump, the entire fuel pressure waveform Wa ascends when the fuel pump supplies the fuel while the fuel injector 10 injects the fuel. That is, the fuel pressure waveform Wa includes a fuel pressure waveform Wb (refer to FIG. 3C) representing a fuel pressure variation due to a fuel injection and a pressure waveform Wu (refer to FIG. 3B) representing a fuel pressure increase by the fuel pump 41.

Even in a case that the fuel pump 41 supplies no fuel while the fuel injector 10 injects the fuel, the fuel pressure in the fuel injection system decreases immediately after the fuel injector 10 injects the fuel. Thus, the fuel pressure waveform Wa descends in the fuel injection system. That is, the fuel pressure waveform Wa includes a waveform Wb representing a fuel pressure variation due to a fuel injection and a waveform Wud (refer to FIG. 3B) representing a fuel pressure decrease in the fuel injection system.

In view of a fact that the non-injection pressure waveform Wu (Wud) detected by the non-injection-cylinder pressure sensor 20 represents a fuel pressure variation in the common-rail 42, the non-injection pressure waveform Wu (Wud) is subtracted from the injection pressure waveform Wa detected by the injection-cylinder pressure sensor 20 to obtain the injection waveform Wb. The fuel pressure waveform shown in FIG. 2C is the injection waveform Wb.

Moreover, in a case that a multiple-injection is performed, a pressure pulsation Wc due to a prior injection, which is shown in FIG. 2C, overlaps with the fuel pressure waveform Wa. Especially, in a case that an interval between injections is short, the fuel pressure waveform Wa is significantly influenced by the pressure pulsation Wc. Thus, it is preferable that the pressure pulsation Wc and the non-injection pressure waveform Wu (Wud) are subtracted from the fuel pressure waveform Wa to compute the injection waveform Wb.

Figure 4:
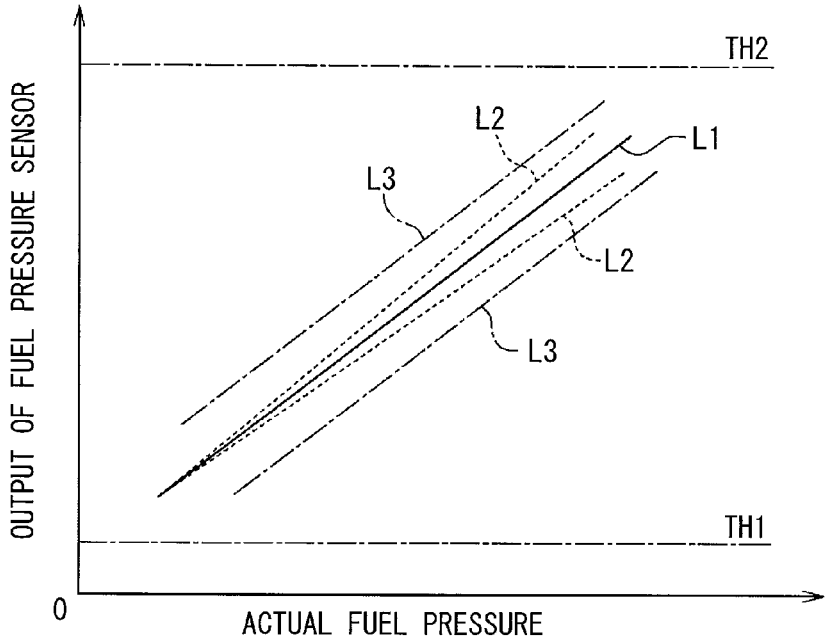
FIG. 4 is a graph showing a characteristic of the fuel pressure sensor output.

FIG. 4 is a graph showing a relationship between an output voltage of the fuel pressure sensor 20 (detected value) and an actual fuel pressure. The output voltage is increased in proportion to the actual fuel pressure. A solid line L1 indicates a characteristic of the fuel pressure sensor 20 when the fuel pressure sensor 20 performs in normal. When an abnormality of a breaking of wire and a short circuit occurs in the fuel pressure sensor 20, the output voltage without being affected by the fuel pressure is fixed on one of a value smaller than a threshold value TH1 and a value larger than or equal to a threshold value TH2. The ECU 30 diagnoses whether the abnormality occurs during an operation of the fuel pump 41 based on a fact that whether the output voltage is in a range from the threshold value TH1 to the threshold value TH2.

When the fuel pressure sensor 20 further deteriorates with age, a characteristic abnormality that a slope of the output voltage characteristic becomes different (refer to dotted lines L2), and a characteristic abnormality (offset abnormality) that the output voltage is shifted by a specified amount (refer to dashed-dotted lines L3) may occur. The above characteristic abnormalities may be detected by comparing two detected values of two fuel pressure sensors which are selected from a plurality of fuel pressure sensors 20 of which pulsation values of the detected values are in a specified range.

Figure 5:
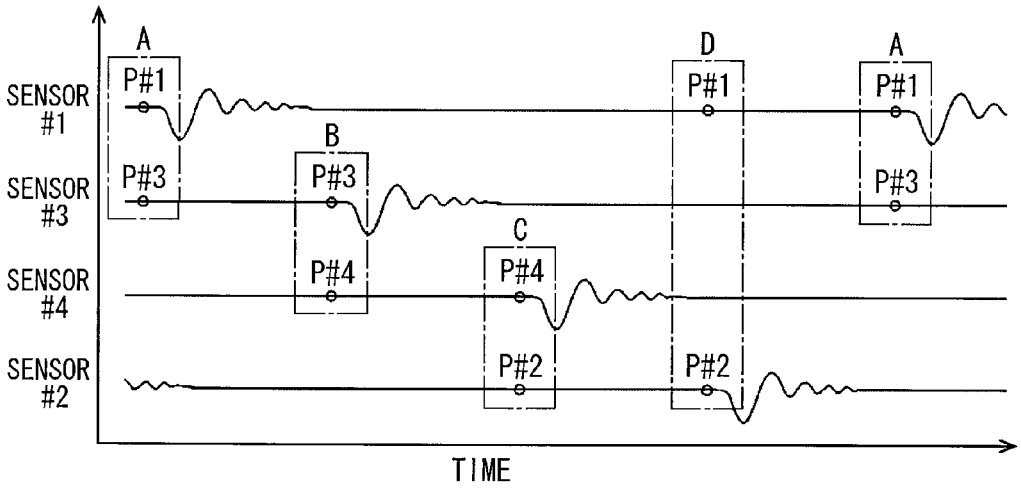
FIG. 5 is a graph showing combinations of detected values P#1 to P#4 for an abnormality-diagnosis according to the first embodiment.

A dashed-dotted line in FIG. 5 indicates combinations (pairs A to D) of the selected fuel pressure sensor. For example, the pair "A" is a combination of both a detected value P#1 of the sensor #1 and a detected value P#3 of the sensor #3. As the same, the pair "B" is a combination of the detected values P#3, P#4, and the pair "C" is a combination of the detected values P#4, P#2, and the pair "D" is a combination of the detected values P#2, P#1.

The above combinations include the fuel pressure sensor (current sensor) 20 provided in the fuel injector (current injector) 10 which will inject the fuel this time, and the fuel pressure sensor (next sensor) 20 provided in the fuel injector (next injector) 10 which will inject the fuel next time. The ECU 30 selects both the current sensor 20 and the next sensor 20 as diagnose objects for diagnosing whether abnormalities occur therein.

It is preferable that a detection timing for the detected values P#1 to P#4 by the current sensor 20 is just before the inflection point P1 occurs in the fuel pressure waveform of the current injector 10. For example, the detected values P#1 to P#4 at a timing of the injection-start-command point t1, or at a timing of a specified time period before the injection-start-command point t1 are used for the diagnosis. Further, it is preferable that a detection timing for the detected values P#1 to P#4 by the next sensor 20 is as the same as the detection timing of the current sensor 20.

When the characteristic abnormalities occur in one of the selected fuel pressure sensors, the detected values are greatly apart from each other. Therefore, the ECU 30 can detect the abnormalities occurring in the fuel pressure sensor 20. Specifically, the ECU 30 diagnoses whether the abnormalities occur according to a result of whether a differential pressure between the detected value of the current sensor 20 and the detected value of the next sensor 20 is larger than or equal to a predetermined threshold value Pth. Based on the diagnosis results of pairs "A" to "D", the fuel pressure sensor which is diagnosed as most abnormal among the other fuel pressure sensors is diagnosed as abnormal (faulty).

An example of a method of the above identification will be described. FIGS. 6A to 6D are charts showing detected values P#1 to P#4 of pairs "A" to "D". It should be noted that the detected values P#1 to P#4 with diagonal lines represent the detected values of abnormal sensors. When the above pressure difference is larger than or equal to the threshold value Pth, the fuel pressure sensors of the relevant pair are temporarily diagnosed as abnormal (denoted by "X"). The number of the above diagnosis (diagnosis number information) will be counted for each sensor 20 (#1-#4).

Figures 6A, 6B, 6C, 6D:
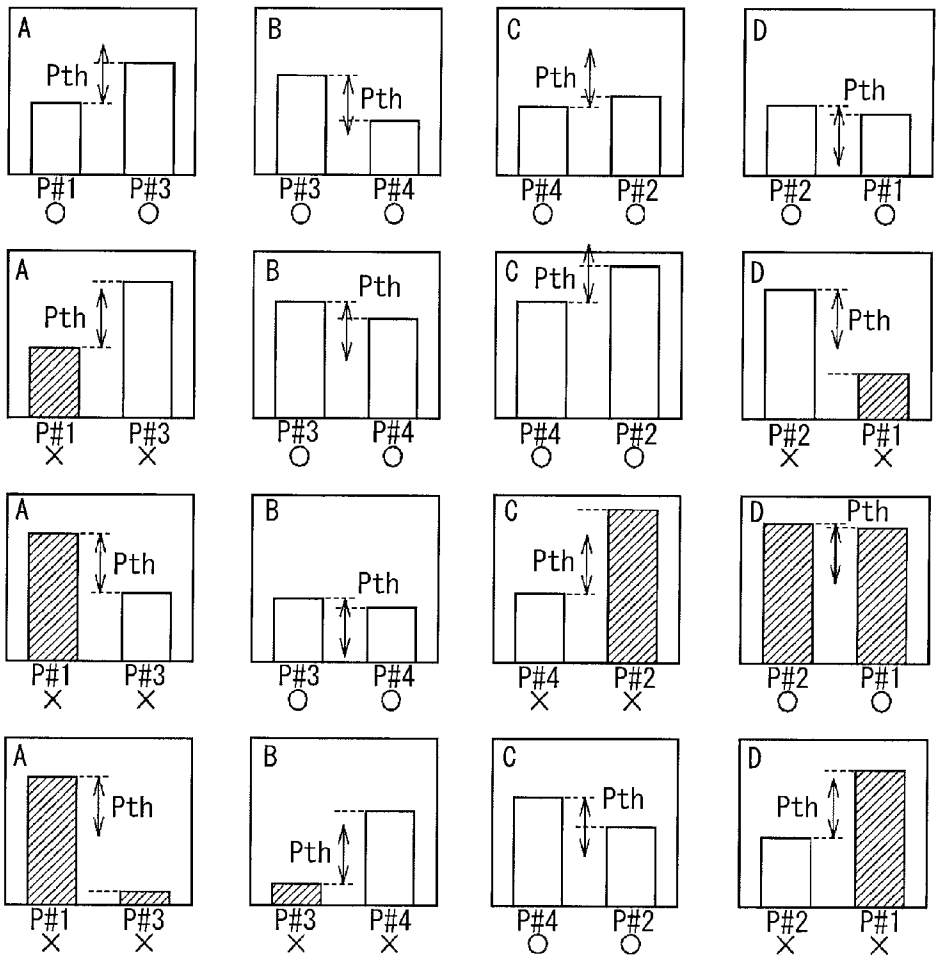
FIG. 6A is a chart showing a diagnosis result in a case where all the sensors are normal.
FIG. 6B is a chart showing a diagnosis result in a case where a sensor #1 is abnormal.
FIG. 6C is a chart showing a diagnosis result in a case where two sensors #1 and #2 are abnormal.
FIG. 6D is a chart showing a diagnosis result in a case where two sensors #1 and #3 are abnormal.

FIG. 6A is a chart showing detected values P#1 to P#4 of pairs "A" to "D" of when all the sensors are normal. In this case, since the pressure differences are smaller than the threshold value Pth in pairs "A" to "D", the ECU 30 diagnoses that the sensors #1 to #4 are normal.

FIG. 6B is a chart showing detected values P#1 to P#4 of pairs "A" to "D" of when only the sensor #1 is abnormal. In this case, the pressure differences are larger than the threshold value Pth in pairs "A" and "D". The sensors #1 and #3 in pair "An" are temporarily diagnosed as abnormal. The sensors #2 and #1 in pair "D" are temporarily diagnosed as abnormal. Thus, the number of the temporal diagnosis for the sensor #1 is the largest; thereby the ECU 30 diagnoses that the sensor #1 is abnormal.

FIG. 6C is a chart showing detected values P#1 to P#4 of pairs "A" to "D" of when the sensors #1 and #2 are abnormal. In this case, the pressure differences are larger than the threshold value Pth in pairs A and C. Thus, the diagnosis number information is "1" with respect to every sensor. The ECU 30 can not diagnose which sensor is abnormal, thereby the conclusion becomes that at least one of the sensors is abnormal.

FIG. 6D is a chart showing detected values P#1 to P#4 of pairs "A" to "D" of when the sensors #1 and #3 are abnormal. In this case, the pressure differences are larger than the threshold value Pth in pairs "A", "B", "D". The diagnosis number information is "2" with respect to the sensors #1 and #3, and the diagnosis number information is "1" with respect to the sensors #4 and #2. Thus, the ECU 30 diagnoses that the sensors #1 and #3 are abnormal by a majority.

Figure 7:
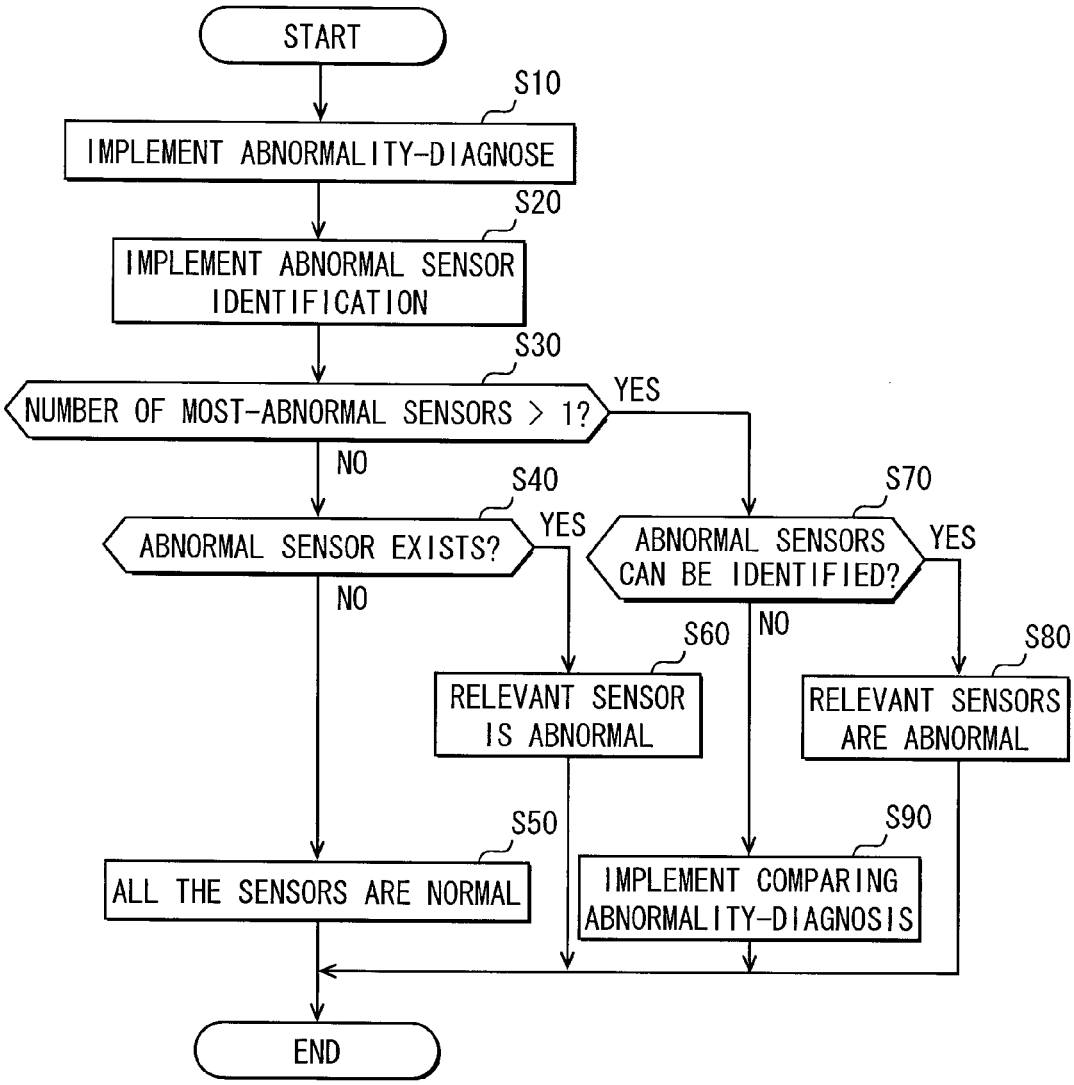
FIG. 7 is a flowchart showing a processing for diagnosing a fuel pressure sensor of FIG. 6.

FIG. 7 is a flowchart showing a procedure of the above diagnosis.

In S10 (abnormality-diagnose portion), the ECU 30 implements the abnormality-diagnosis for each pair to compare the pressure difference with the threshold value Pth. In S20 (abnormal sensor identification portion), the ECU 30 identifies which sensor (most-abnormal sensor) has the largest diagnosis number information.

In S30, the ECU 30 determines whether the number of the most-abnormal sensor(s) is larger than "1". When the number of the most-abnormal sensor(s) is smaller than or equal to "1" (S30: NO), the ECU 30 proceeds to S40. In S40, the ECU 30 determines whether an abnormal sensor exists. When no abnormal sensor exists (S40: NO), the ECU 30 proceeds to S50. In S50, the ECU 30 diagnoses that all the sensors #1 to #4 are normal. When the abnormal sensor exists (S40: YES), the ECU 30 proceeds to S60. In S60, the ECU 30 diagnoses that the relevant sensor (most-abnormal sensor) is abnormal.

When the number of the most-abnormal sensor(s) is larger than "1" (S30: YES), the ECU 30 proceeds to S70. In S70, the ECU 30 determines whether the numbers of diagnosis of all the sensors are not the same. When the numbers of diagnosis of all the sensors are not the same (S70: YES), the ECU 30 proceeds to S80. In S80, the ECU 30 diagnoses that the relevant sensors (most-abnormal sensor) are abnormal.

When the numbers of diagnosis of all the sensors are the same (S70: NO), the ECU 30 proceeds to S90. In S90, the ECU 30 implements a comparing abnormality-diagnosis.

Hereinafter, the comparing abnormality-diagnosis will be described. In a case where a specified time period is passed after the engine is stopped, the ECU 30 obtains the detected values of the sensors #1 to #4 when the fuel pressure is nearly equal to the atmosphere pressure. The ECU 30 computes deviation values for the detected values with respect to the atmosphere pressure. When one of the deviation values is larger than a specified value, the sensor having the above deviation value is diagnosed to be abnormal. Thus, the ECU 30 can diagnose whether each sensor is abnormal. In this case, the above comparing abnormality-diagnosis can only be implemented when the engine is stopped.

The ECU 30 can implement the abnormality-diagnosis in S50, S60, and S80 even when the engine is operating. Since the abnormality-diagnosis is diagnosed by comparing two detected values, the abnormality-diagnosis can be diagnosed not only by the slope of the output voltage characteristic but also by the offset abnormality.

Further, according to diagnosis results of the combinations (pairs "A" to "D") of the selected sensors, the abnormal sensor(s) can be diagnosed by the majority.

Furthermore, in the present embodiment, the current sensor 20 and the next sensor 20 are selected as the diagnosing objects. Therefore, a diagnosing accuracy can be improved since the abnormality-diagnosis is implemented by using the detected values when an affect of the pressure pulsation We becomes smaller.

Second Embodiment

According to the first embodiment, the ECU 30 determines whether the abnormal sensor exists by the majority based on the diagnosis number information. According to a second embodiment, when the diagnosis for pairs "A" to "D" are implemented in S10, the ECU 30 (comparing portion) diagnoses a maximum-detected-value sensor (comparing information). Then, the ECU 30 identifies the abnormal sensor based on the diagnosis number information and the comparing information.

FIGS. 8A and 8B are charts showing diagnosis results in a case where the detected value of the sensor #1 is extremely large (High-abnormality) and the detected value of the sensor #2 is extremely small (Low-abnormality). FIG. 8A is a chart showing a diagnosis result according to the first embodiment. FIG. 8B is a chart showing a diagnosis result according to the present embodiment.

According to the diagnosis result shown in FIG. 8A, the diagnosis number information is "2" with respect to every sensors. Thus, the ECU 30 can not diagnose which sensor is abnormal. According to the diagnosis result shown in FIG. 8B, the number of the High-abnormality of the sensor #1 and the number of the Low-abnormality of the sensor #4 are the largest (the number is "2"). Thus, the ECU 30 can diagnose that the sensors #1 and #4 are abnormal.

As the above description, even in a case where the ECU 30 can not diagnose which sensor is abnormal by the diagnosis number information, the ECU 30 can diagnose which sensor is abnormal based on both the diagnosis number information and the comparing information, according to the present embodiment.

Other Embodiment

The present invention is not limited to the embodiments described above, but may be performed, for example, in the following manner. Further, the characteristic configuration of each embodiment can be combined.

(1) The present disclosure may apply to a fuel injection system in which a fuel pressure sensor 20 is provided to any one of the fuel injectors 10 and no fuel pressure sensor 20 is provided to the other fuel injectors 10.

For example, two fuel pressure sensors 20 are provided to two fuel injectors 10 among the four fuel injectors 10 respectively provided to four cylinders in a four-cylinder engine. In this case, it is preferable that the abnormality-diagnosis shown in S10 of FIG. 7 is implemented.

(2) It is not limited that a pair of the current sensor 20 and the next sensor 20 is selected as the diagnosing object. The diagnosis object may be a pair of the current sensor 20 and a next-next sensor 20, or may be a pair of the next sensor 20 and the next-next sensor 20. The next-next sensor 20 is the fuel pressure sensor 20 provided in the fuel injector 10 which will inject fuel successively the next. It is required that the pressure pulsation of the detected value of the selected sensor is in the specified range. Therefore, it is forbidden to select the sensor provided to the fuel injector 10 which is currently injecting the fuel. It is required that the sensor in a case where a specified time period passed after the inflection point P4 is selected.

The fuel pressure sensor 20 can be arranged at any place in a fuel supply passage between an outlet 42*a* of the common-rail 42 and the injection port 11*b*. For example, the fuel pressure sensor 22 can be arranged in a high-pressure pipe 42*b* connecting the common-rail 42 and the fuel injector 10. The fuel supply passage of each cylinder and the common rail 42 corresponds to a fuel flowing passage leading from the accumulator container to the injection port of each cylinder.

What is claimed is:

1. A fuel-pressure-sensor diagnosis device applied to a fuel injection system having a plurality of fuel injectors provided to each cylinder of an internal combustion engine, an accumulator accumulating a high-pressure fuel and distributing the fuel to the fuel injectors, a plurality of fuel pressure sensors detecting a fuel pressure in a fuel supply passage at multiple points from the accumulator to an injection port of the fuel injector, and a control portion controlling the fuel injectors by using a computed result which is computed based on a variation in the fuel pressure detected by the fuel pressure sensor due to a fuel injection through an injection port of the fuel injector, the fuel-pressure-sensor diagnosis device comprising:

an abnormality-diagnose portion selecting, among the multiple fuel pressure sensors, two pressure sensors of which pulsation values of the detected fuel pressure are in a specified range, the abnormality-diagnose portion diagnosing whether selected two fuel pressure sensors are faulty by comparing the detected values detected by the selected two fuel pressure sensors, an identifying portion identifying a faulty fuel pressure sensor among the multiple fuel pressure sensors based on diagnose results of each combination of the selected sensors, which are made by the abnormality-diagnose portion; and a counting portion counting a number of temporal diagnoses for each of pressure sensors diagnosed by the abnormality-diagnose portion, wherein:

each of the fuel pressure sensors is provided to the respective fuel injector, each of the fuel pressure sensors detects a variation in the fuel pressure with respect to the respective fuel injector for computing an injection state of the respective fuel injector, when the fuel injectors injects the fuel in a specified order, the fuel injector which will inject the fuel this time is referred to as a current injector, the fuel injector which will inject the fuel next time is referred to as a next injector, the abnormality-diagnose portion selects the fuel pressure sensor provided to the current injector and the fuel pressure sensor provided to the next injector among the multiple fuel pressure sensors as diagnosing objects for diagnosing; and the identifying portion identifies a number of the faulty pressure sensors of which the number counted by the counting portion is the largest.

2. A fuel-pressure-sensor diagnosis device, according to claim 1, further comprising:

a comparing portion obtaining a comparing information which shows a maximum detected value of the detected values of the fuel pressure sensors selected by the abnormality-diagnose portion, wherein:

the identifying portion identifies the faulty fuel pressure sensor based on the diagnose results made by the abnormality-diagnose portion and the comparing information obtained by the comparing portion.

3. A fuel-pressure-sensor diagnosis device, according to claim 1, wherein the plurality of fuel pressure sensors detect the fuel pressure after the engine is stopped.

4. A fuel-pressure-sensor diagnosis device applied to a fuel injection system having a plurality of fuel injectors provided to each cylinder of an internal combustion engine, an accumulator accumulating a high-pressure fuel and distributing the fuel to the fuel injectors, a plurality of fuel pressure sensors detecting a fuel pressure in a fuel supply passage at multiple points from the accumulator to an injection port of the fuel injector, and a control portion controlling the fuel injectors by using a computed result which is computed based on a variation in the fuel pressure detected by the fuel pressure sensor due to a fuel injection through an injection port of the fuel injector, the fuel-pressure-sensor diagnosis device comprising:

an abnormality-diagnose portion selecting, among the multiple fuel pressure sensors, two pressure sensors of which pulsation values of the detected fuel pressure are in a specified range, the abnormality-diagnose portion diagnosing whether selected two fuel pressure sensors are faulty by comparing the detected values detected by the selected two fuel pressure sensors;

an identifying portion identifying a faulty fuel pressure sensor among the multiple fuel pressure sensors based on diagnose results of each combination of the selected sensors, which are made by the abnormality-diagnose portion; and counting portion counting a number of temporal diagnoses for each of fuel pressure sensors diagnosed by the abnormality-diagnose portion, wherein the identifying portion identifies a number of the faulty fuel pressure sensors of which the number counted by the counting portion is the largest.

5. A fuel-pressure-sensor diagnosis device, according to claim 4, further comprising:

a comparing portion obtaining a comparing information which shows a maximum detected value of the detected values of the fuel pressure sensors selected by the abnormality-diagnose portion, wherein:

the identifying portion identifies the faulty fuel pressure sensor based on the diagnose results made by the abnormality-diagnose portion and the comparing information obtained by the comparing portion.

6. A fuel-pressure-sensor diagnosis device, according to claim 4, wherein the plurality of fuel pressure sensors detect the fuel pressure after the engine is stopped.

* * * * *